US010537164B1

(12) United States Patent
Chung et al.

(10) Patent No.: US 10,537,164 B1
(45) Date of Patent: Jan. 21, 2020

(54) COSMETIC CONTAINER WITH ANTI-CONTAMINATION FUNCTION FOR WIPER

(71) Applicant: CTK CO., LTD., Gyeonggi-do (KR)

(72) Inventors: In Yong Chung, Seoul (KR); Jung Hun Jun, Daejeon (KR)

(73) Assignee: CTK CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/167,168

(22) Filed: Oct. 22, 2018

(51) Int. Cl.
*A46B 17/08* (2006.01)
*A45D 34/04* (2006.01)
*A45D 40/26* (2006.01)

(52) U.S. Cl.
CPC ..... *A45D 34/046* (2013.01); *A45D 40/267* (2013.01); *A46B 2200/1053* (2013.01)

(58) Field of Classification Search
CPC ..... A45D 34/046; A45D 40/267; A46B 2200/1053
USPC ..... 401/122
See application file for complete search history.

(56) References Cited

U.S. PATENT DOCUMENTS 8,231,297 B2 * 7/2012 Legassie ..... A45D 40/267 401/117
10,271,630 B2 * 4/2019 Yoo ..... A45D 34/00

FOREIGN PATENT DOCUMENTS

| | | |
|---|---|---|
| KR | 200230152 | 4/2001 |
| KR | 200350230 | 5/2004 |
| KR | 200421424 | 7/2006 |
| KR | 200442004 | 9/2008 |

* cited by examiner

*Primary Examiner* — Jennifer C Chiang
(74) *Attorney, Agent, or Firm* — IPLA P.A.; James E. Bame

(57) ABSTRACT

A cosmetic container with an anti-contamination function for a wiper is provided, where a ring member guides the introduction and discharge of a brush while being moved along the inner surface of a wiper by the pressure applied from a brush rod when the brush rod is introduced into and discharged from a cosmetic container. Thereby, it is possible to prevent the inner surface of the wiper from being contaminated by the contents such as mascara adhered to the brush and to ensure simplified use of the contents such as mascara. Further, since the inner surface of the wiper is not contaminated by the contents such as mascara, it is possible to ensure easy application of the contents such as mascara, which is adhered to the brush passing through the wiper.

5 Claims, 3 Drawing Sheets

COSMETIC CONTAINER WITH ANTI-CONTAMINATION FUNCTION FOR WIPER

BACKGROUND

The present invention relates to a cosmetic container, and more particularly to a cosmetic container with an anti-contamination function for a wiper, in which a ring member guides the introduction and discharge of a brush while being moved along the inner surface of the wiper by the pressure applied from a brush rod when the brush rod is introduced into and discharged from the cosmetic container, thereby being capable of preventing the inner surface of the wiper from being contaminated by the contents adhered to the brush.

In general, mascara is a cosmetic that thickens the eyelashes, and a user can apply the mascara, which is adhered to a brush and exposed through a brush rod while being stored in a container in a liquid or creamy phase, to the eyelashes.

When the mascara is applied with the brush in use, a large amount of mascara may be transferred to the brush rod and the brush, which may cause the mascara to flow down through the brush rod. In addition, the excessive use of mascara on the eyelashes may cause a phenomenon in which the eyelashes agglomerate. To prevent this phenomenon, a wiper is mounted on the upper end portion of the container to wipe the excessive mascara adhered to the brush rod and the brush, so that the user can apply makeup with an appropriate amount of mascara on the brush.

As an example of the wiper structure described above, Korean Utility Model Registration No. 20-0350230 discloses a wiper structure for a mascara container. In the disclosed wiper structure, a wiper on the lower end of a wiper body scrapes mascara off a brush rod and an elongated groove is formed in the inner surface of the wiper in a vertical longitudinal direction to apply a slightly greater amount of mascara to the eyelashes for ensuring easier makeup application.

In addition, Korean Utility Model Registration No. 20-0421424 discloses a wiper structure for a mascara container, in which a multistage uneven portion is formed on the inner surface of a wiper of a wiper body to evenly scrape off mascara liquid so as to assist a user in putting on eyelash makeup with the mascara that is evenly adhered to a brush.

However, these registered utility models have problems in that the mascara adhered to the brush passing through the wiper may be deposited on the inner wall of the upper end portion of the wiper body, thereby contaminating the inner wall, and in that a process of scraping down and removing the mascara on the inner wall of the upper end portion of the wiper body is complicated.

Further, since the brush, which is discharged by way of the wiper, may be smeared with the mascara that remains dry on the inner wall of the upper end portion of the wiper body, it may be necessary to separate the dried mascara through a separate process, which causes inconvenience in use.

SUMMARY OF THE INVENTION

Therefore, the present invention has been made in view of the above problems, and it is one object of the present invention to prevent the inner surface of a wiper from being contaminated by the contents such as mascara adhered to a brush using a ring member, which guides the introduction and discharge of the brush while being moved along the inner surface of the wiper by the pressure applied from a brush rod when the brush rod is introduced into and discharged from a cosmetic container.

In addition, it is another object of the present invention to assist a user in easily using the contents such as mascara adhered to a brush passing through a wiper by preventing the inner surface of the wiper from being contaminated by the contents such as mascara.

In accordance with an aspect of the present invention, the above and other objects can be accomplished by the provision of a cosmetic container with an anti-contamination function for a wiper, the cosmetic container including a container in which contents are stored, the wiper mounted to an upper end portion of the container to scrape the contents adhered to a brush rod that is being discharged from the container, a ring guide mounted in the wiper to guide movement of a ring member and prevent separation of the ring member, and the ring member configured to prevent a brush from coming into contact with an inner surface of the wiper while being moved along the ring guide by pressure applied from the brush rod when the brush rod is introduced into or discharged from the container.

The wiper includes a body having a tubular shape to define a hollow interior and mounted to the upper end portion of the container, and a wiper member formed on an inner circumferential surface of a front end portion of the body to scrape the contents adhered to the brush rod.

The wiper further includes a fitting space formed in an outer circumferential surface of a rear end portion of the body so that a fitting protrusion of the ring guide is snap-fitted into the fitting space.

The ring guide includes a body having a tubular shape to guide movement of the ring member through a hollow interior thereof, a stepped movement control portion formed on an inner circumferential surface of a front end portion of the body to control the movement of the ring member, and a separation-preventing member mounted on an outer circumferential surface of a rear end portion of the body to prevent separation of the ring member.

The cosmetic container further includes a fitting protrusion formed on an outer circumferential surface of the separation-preventing member so as to be snap-fitted into a fitting space in the wiper.

The ring member includes a body having a tubular shape to define a hollow interior, a first stepped locking portion formed on an inner circumferential surface of the body and configured to be caught by a discharge guidance protrusion of the brush rod so that the pressure is applied from the brush rod to the ring member when the brush rod is discharged from the container, and a second stepped locking portion formed on an outer circumferential surface of the body and configured to stop movement of the ring member when caught by a stepped movement control portion of the ring guide.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, reference will now be made in detail to the exemplary embodiment of the present invention with reference to the accompanying drawings in order to allow those skilled in the art to easily implement the present invention. However, the present invention may be implemented in various other forms and is not limited to the embodiment described herein.

Figure 1:
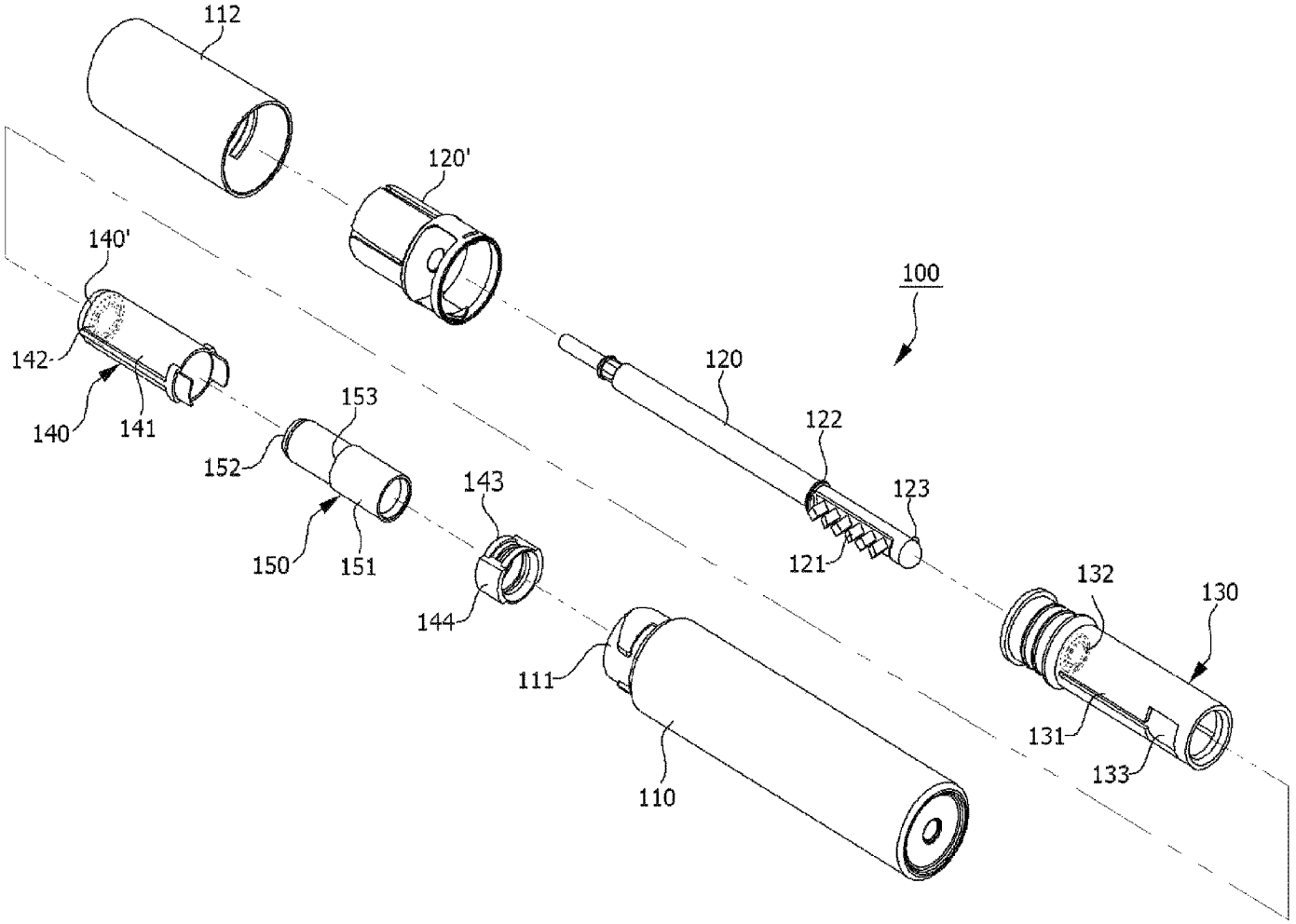
FIG. 1 is an exploded perspective view of a cosmetic container according to the present invention.

FIG. 1 is an exploded perspective view of a cosmetic container according to the present invention.

The cosmetic container 100 of the present invention includes a container 110, a brush rod 120 provided with a brush 121, a wiper 130, a ring guide 140, and a ring member 150. The container 110 stores therein the content such as mascara liquid. The container 110 is formed on the upper portion thereof with an outlet port 111, through which the contents are discharged. The container 110 includes a cap 112 detachably attached to the outlet port 111 in order to open and close the outlet port 111.

The brush rod 120 is configured in a manner such that the brush 121 is formed on the cut surface of one end to absorb and apply the contents and such that a fixing guidance member 120' is mounted on the other end so as to be inserted into the cap 112. The brush rod 120 may have the overall shape of toothbrush.

In addition, the brush rod 120 is formed on opposite sides of the brush 121 with a discharge guidance protrusion 122 and an introduction guidance protrusion 123, which apply pressure to the ring member 150 in the direction of movement of the brush rod 120.

The wiper 130 includes a body 131, which has a tubular shape so that the brush rod 120 and the brush 121 are movable through a hollow interior thereof. The body 131 is mounted on the upper end portion of the container 110. A wiper member 132 is formed on the inner circumferential surface of the body 131 to scrape the contents adhered to the brush rod 120.

In addition, the outer circumferential surface of the rear end portion of the body 131 is formed therein with a fitting space 133, into which a fitting protrusion 144 of the ring guide 140 is snap-fitted.

The ring guide 140 includes a body 141, which has a tubular shape so as to guide the movement of the ring member 150 through a hollow interior thereof, a stepped movement control portion 142, which is formed on the inner circumferential surface of the front end portion of the body 141 to control the movement of the ring member 150, and a separation-preventing member 143, which is mounted on the outer circumferential surface of the rear end portion of the body 141 to prevent separation of the ring member 150.

In addition, the ring guide 140 further includes the fitting protrusion 144, which is formed on the outer circumferential surface of the separation-preventing member 143 so as to be snap-fitted into the fitting space 133 in the wiper 130.

The ring member 150 includes a body 151, which has a tubular shape defining a hollow interior, and a first stepped locking portion 152, which is formed on the inner circumferential surface of the body 151 and is caught by the discharge guidance protrusion 122 of the brush rod 120 so that pressure is applied from the brush rod 120 to the ring member 150 when the brush rod 120 is discharged from the container 110.

In addition, the ring member 150 further includes a second stepped locking portion 153, which is formed on the outer circumferential surface of the body 151. In the state in which the discharge guidance protrusion 122 of the brush rod 120 is caught by the first stepped locking portion 152, after the body 151 is moved by a predetermined distance in the direction in which the brush rod 120 is discharged, the second stepped locking portion 153 is caught by the stepped movement control portion 142 of the ring guide 140 so that the movement of the body 151 is stopped.

Next, the use procedure of the cosmetic container of the present invention having the above-described configuration will be described.

Figure 2:
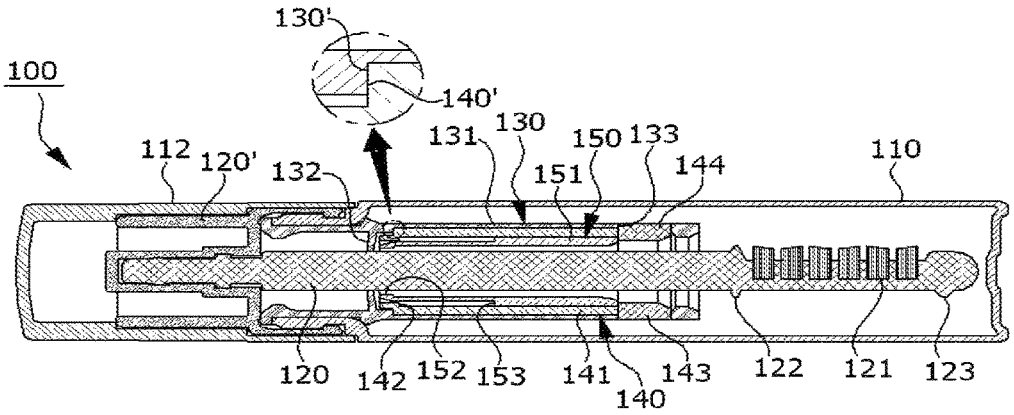
FIG. 2 is a cross-sectional view of the cosmetic container according to the present invention.

First, as illustrated in FIG. 2, when the ring member 150 is inserted into the body 141 of the ring guide 140, and thereafter, the separation-preventing member 143 is mounted on the rear end portion of the body 141, the end of the ring member 150 is brought into close contact with the separation-preventing member 143. Thereby, the separation-preventing member 143 may prevent the ring member 150 from being separated from the body 141.

Then, when the ring guide 140, into which the ring member 150 has been inserted, is inserted into the wiper 130, a stepped portion 140' formed on the outer circumferential surface of the ring guide 140 is caught by a stepped portion 130' formed on the inner circumferential surface of the wiper 130 so that the movement of the ring guide 140 inside the wiper 130 is stopped. At the same time, the fitting protrusion 144 formed on the separation-preventing member 143 of the ring guide 140 is snap-fitted into the fitting space 133 in the wiper 130.

At this time, since the stepped portion 140' of the ring guide 140 is caught by the stepped portion 130' of the wiper 130 and the fitting protrusion 144 of the separation-preventing member 143 is snap-fitted into the fitting space 133 so that the ring guide 140 is fixed to the wiper 130, it is possible to prevent the ring guide 140 from moving inside the wiper 130. Subsequently, after the wiper 130, which has been coupled to the ring member 150 and the ring guide 140, is inserted into the container 110 in which the contents such as mascara are stored so that the front end portion of the wiper 130 is seated in the outlet port 111 of the container 110, the brush rod 120, which is mounted in the cap 112 with the fixing guidance member 120', is moved into the body 131 of the wiper 130.

The end of the brush rod 120, which has been moved into the body 131, is coupled to the end of the body 151 of the ring member 150, and at the same time, the introduction guidance protrusion 123 of the brush rod 120 is caught by the end of the body 151 of the ring member 150. In this state, when the brush rod 120 is moved into the container 110, the introduction guidance protrusion 123 of the brush rod 120 applies pressure to the end of the body 151 of the ring member 150, whereby the ring member 150 is moved into the container 110 by the pressure applied thereto from the brush rod 120.

When the end of the ring member 150, which has been moved into the container 110, is caught by the separation-preventing member 143 of the ring guide 140, the movement of the ring member 150 is stopped. Even in the state in which the movement of the ring member 150 is stopped, the brush rod 120 is moved so as to be introduced into the container 110.

At this time, the introduction guidance protrusion 123 of the brush rod 120, which has a curved shape, passes through the first stepped locking portion 152 of the ring member 150, and the brush 121 and the discharge guidance protrusion 122 of the brush rod 120 sequentially pass through the first stepped locking portion 152 of the ring member 150, so that the brush 121 of the brush rod 120 is located inside the container 110.

In this state, the cap 112 is mounted around the outlet port 111 of the container 110 to close the outlet port 111, whereby the manufacture of the cosmetic container 100 may be completed.

Figure 3:
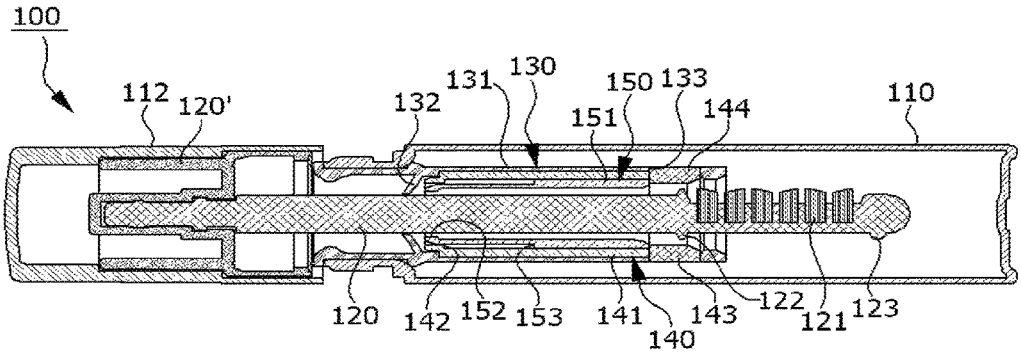
FIGS. 3 to 6 are views illustrating the operational state of the cosmetic container according to the present invention.

When attempting to use the contents such as mascara stored in the container 110 of the cosmetic container 100 manufactured through the above-described procedure, as illustrated in FIG. 3, the user rotates the cap 112 to release the cap 112 from the outlet port 111, and then moves the cap 112 away from the container 110, i.e., so as to be separated from the container 110.

When the cap 112 is moved away from the container 110, the brush rod 120 mounted in the cap 112 is also moved away from the container 110, so that the discharge guidance protrusion 122 of the brush rod 120 is caught by the first stepped locking portion 152 of the ring member 150. Thereby, the ring member 150 is also moved away from the container 110.

At this time, the contents such as mascara adhered to the outer circumferential surface of the brush rod 120, which is moved away from the container 110, is scraped by the wiper member 132, which is formed inside the wiper 130 and remains in close contact with the outer circumferential surface of the brush rod 120. In this way, it is possible to prevent the contents such as mascara from moving out of the container 110 along with the brush rod 120 as much as possible.

Figure 4:
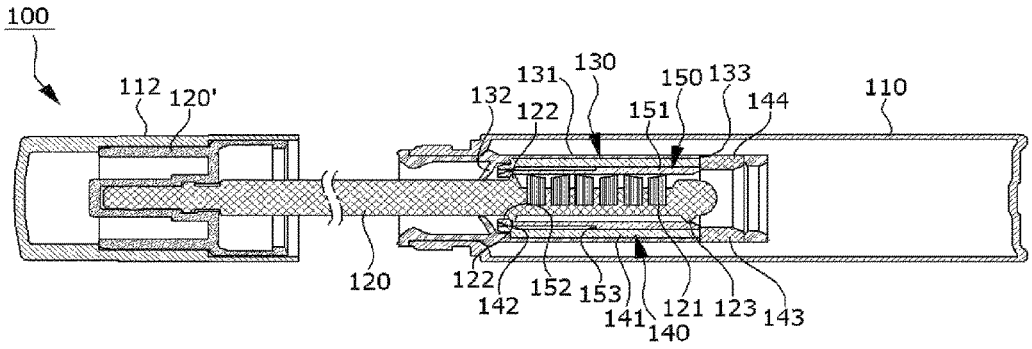

When the discharge guidance protrusion 122, the brush 121, and the introduction guidance protrusion 123 of the brush rod 120 are moved into the ring member 150 by the movement of the brush rod 120 away from the container 110, as illustrated in FIG. 4, the discharge guidance protrusion 122 of the brush rod 120 is caught by the first stepped locking portion 152 of the ring member 150. In this state, the ring member 150 is moved by a predetermined distance along with the brush rod 120.

Figure 5:
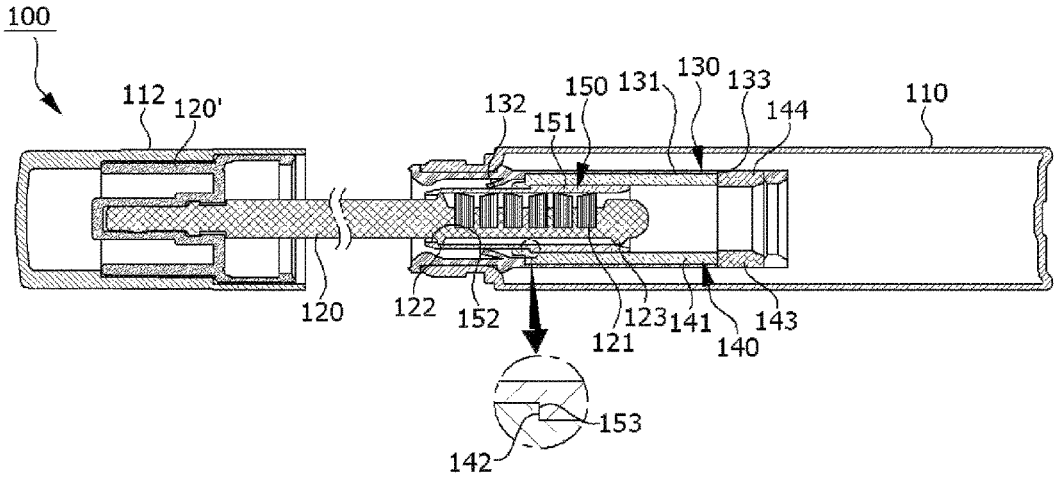

At this time, when the ring member 150 is moved in the state in which the front end portion of the ring member 150 pushes the wiper member 132 so that the wiper member 132 is brought into close contact with the outer circumferential surface of the ring member 150, as illustrated in FIG. 5, the second stepped locking portion 153 of the ring member 150 is caught by the stepped movement control portion 142 of the ring guide 140 so that the movement of the ring member 150 is stopped, and at the same time, the front end portion of the ring member 150 is located on the front end portion of the body 131 of the wiper 130.

Figure 6:
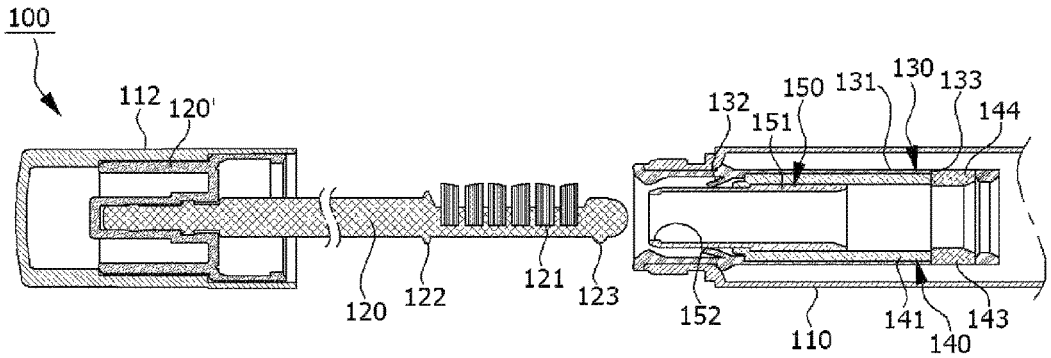

When the brush rod 120 continues to be moved away from the container 110 in this state, as illustrated in FIG. 6, the first stepped locking portion 152 of the ring member 150 is deformed so as to expand outwards by the pressure applied from the discharge guidance protrusion 122 of the brush rod 120. The deformed first stepped locking portion 152 is restored to the original state by the elasticity thereof at the same time as the discharge guidance protrusion 122 passes through the first stepped locking portion 152.

When the introduction guidance protrusion 123 passes through the restored first stepped locking portion 152 while scraping some of the contents adhered to the brush 121 and the contents adhered to the outer circumferential surface of the brush rod 120 formed with the brush 121, the brush rod 120 is discharged from the container 110, and the user can easily apply the contents such as mascara adhered to the brush 121 of the discharged brush rod 120 while repeating the above-described procedure.

Here, since the ring member 150 is moved to the front end portion of the wiper 130 through the discharge of the brush rod 120, it is possible to prevent the inside of the wiper 130 from being contaminated by the contents such as mascara adhered to the brush 121 and to ensure simplified use of the contents. As is apparent from the above description, according to the present invention, through the use of a ring member, which guides the introduction and discharge of a brush while being moved along the inner surface of a wiper by the pressure applied from a brush rod when the brush rod is introduced into and discharged from a cosmetic container, it is possible to prevent the inner surface of the wiper from being contaminated by the contents such as mascara adhered to the brush and to ensure simplified use of the contents such as mascara.

In addition, according to the present invention, since the inner surface of the wiper is not contaminated by the contents such as mascara, it is possible to ensure easy application of the contents such as mascara, which is adhered to the brush passing through the wiper.

Although the preferred embodiment of the present invention has been disclosed with reference to the accompanying drawings for illustrative purposes, those skilled in the art will appreciate that various modifications, additions and substitutions are possible, without departing from the scope and spirit of the invention as disclosed in the accompanying claims.

Hence, the scope of the present invention should not be limited to and defined by the above-described embodiment, but should be defined by the following claims and equivalents of the claims.

What is claimed is:

1. A cosmetic container with an anti-contamination function for a wiper, the cosmetic container comprising:

a container in which contents are stored;

the wiper mounted to an upper end portion of the container to scrape the contents adhered to a brush rod that is being discharged from the container;

a ring guide mounted in the wiper to guide movement of a ring member and prevent separation of the ring member; and the ring member configured to prevent a brush from coming into contact with an inner surface of the wiper while being moved along the ring guide by pressure applied from the brush rod when the brush rod is introduced into or discharged from the container, wherein the wiper comprises:

a body having a tubular shape to define a hollow interior and mounted to the upper end portion of the container;

a wiper member formed on an inner circumferential surface of a front end portion of the body to scrape the contents adhered to the brush rod; and a fitting space formed in an outer circumferential surface of a rear end portion of the body so that a fitting protrusion of the ring guide is snap-fitted into the fitting space.

2. The cosmetic container according to claim 1, wherein the ring member comprises:

a body having a tubular shape to define a hollow interior;

a first stepped locking portion formed on an inner circumferential surface of the body and configured to be caught by a discharge guidance protrusion of the brush rod so that the pressure is applied from the brush rod to the ring member when the brush rod is discharged from the container; and a second stepped locking portion formed on an outer circumferential surface of the body and configured to stop movement of the ring member when caught by a stepped movement control portion of the ring guide.

3. The cosmetic container according to claim 1, wherein the ring guide comprises:

a body having a tubular shape to guide movement of the ring member through a hollow interior thereof;

a stepped movement control portion formed on an inner circumferential surface of a front end portion of the body to control the movement of the ring member; and a separation-preventing member mounted on an outer circumferential surface of a rear end portion of the body to prevent separation of the ring member.

4. The cosmetic container according to claim 3, further comprising a fitting protrusion formed on an outer circumferential surface of the separation-preventing member so as to be snap-fitted into a fitting space in the wiper.

5. The cosmetic container according to claim 3, wherein the ring member comprises:

a body having a tubular shape to define a hollow interior;

a first stepped locking portion formed on an inner circumferential surface of the body and configured to be caught by a discharge guidance protrusion of the brush rod so that the pressure is applied from the brush rod to the ring member when the brush rod is discharged from the container; and a second stepped locking portion formed on an outer circumferential surface of the body and configured to stop movement of the ring member when caught by a stepped movement control portion of the ring guide.

* * * * *